US008026883B2

(12) United States Patent
Meng et al.

(10) Patent No.: US 8,026,883 B2
(45) Date of Patent: Sep. 27, 2011

(54) LIQUID CRYSTAL DISPLAY HAVING GATE DELAY COMPENSATOR

(75) Inventors: Kai Meng, Shenzhen (CN); Xiao-Jing Qi, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 969 days.

(21) Appl. No.: 11/998,022

(22) Filed: Nov. 27, 2007

(65) Prior Publication Data

US 2008/0122876 A1 May 29, 2008

(30) Foreign Application Priority Data

Nov. 27, 2006 (TW) ..... 95143791 A

(51) Int. Cl.
*G09G 3/36* (2006.01)

(52) U.S. Cl. ..... 345/87

(58) Field of Classification Search ..... 345/87, 345/88, 92, 93, 98, 100, 103, 204, 214
See application file for complete search history.

(56) References Cited

U.S. PATENT DOCUMENTS

| | | | | |
|---|---|---|---|---|
| 5,623,279 | A * | 4/1997 | Itakura et al. | 345/98 |
| 6,407,729 | B1 | 6/2002 | Moon | |
| 6,862,013 | B2 * | 3/2005 | Takeuchi et al. | 345/92 |
| 7,133,034 | B2 * | 11/2006 | Park et al. | 345/204 |
| 2004/0196241 | A1 * | 10/2004 | Lee et al. | 345/94 |

FOREIGN PATENT DOCUMENTS

| | | | |
|---|---|---|---|
| TW | 200417974 | A | 9/2004 |
| TW | I240236 | B | 9/2005 |

* cited by examiner

*Primary Examiner* — Alexander Eisen
*Assistant Examiner* — Mark Regn
(74) *Attorney, Agent, or Firm* — Altis Law Group, Inc.

(57) ABSTRACT

A liquid crystal display (400) includes a liquid crystal panel (430), a scanning driver (410), a data driver (420), and a compensator (440). The liquid crystal panel includes gate lines (401) parallel to each other, data lines (402) intersecting the gate lines, and TFTs (403) arranged at each intersection. The scanning driver is configured for providing scanning signals. The compensator is configured for compensating the scanning signals. The compensator comprises switching elements (450) connected to tail ends of the gate lines respectively. When one gate line is scanned, a high compensating voltage is applied to the tail end through a corresponding switching element to accelerate to turn on the TFTs adjacent to the tail end. And at an end of the scanning time, a low compensating voltage is applied to the tail end through the corresponding switching element to accelerate to turn off the TFTs adjacent to the tail end.

14 Claims, 4 Drawing Sheets

LIQUID CRYSTAL DISPLAY HAVING GATE DELAY COMPENSATOR

The present invention relates to liquid crystal displays (LCDs) having compensator for reducing gate delays, and driving methods thereof.

GENERAL BACKGROUND

With the LCDs applied to more and more fields, the LCDs have a trend to become larger in size, which means larger viewing area and high definition. Generally, LCDs employing thin film transistors (TFTs), which are called TFT-LCDs, have a problem of gate delay due to the long gate lines. Gate delay usually results in image flicker or other problems.

Referring to FIG. 3, a typical LCD 100 includes a scanning driver 110, a data driver 120, and a liquid crystal panel 130. The scanning driver 110 is configured for providing a plurality of scanning signals to the liquid crystal panel 130, and the data driver 120 is configured for providing a plurality of gray scale voltages to the liquid crystal panel 130.

The liquid crystal panel 130 includes a plurality of gate lines 101 parallel to each other, a plurality of data lines 102 which are parallel to each other and intersect the gate lines 101, a plurality of TFTs 103 arranged at each cross of the gate line 101 and the data line 102, a plurality of pixel electrodes 104, and a plurality of common electrodes 105 opposite to the pixel electrodes 104. A minimal area constituted by two adjacent gate lines 101 and two adjacent data lines 102 is defined as a pixel area. The scanning driver 110 outputs a plurality of scanning signals to the gate lines 101 sequencially. The data driver 120 applies a plurality of gray scale voltages to the pixel electrodes 104 through corresponding TFTs 103 when a gate line 101 is scanned.

Referring also to FIG. 4, an equivalent circuit diagram of a pixel area is shown. A gate electrode 1031 of the TFT 103 is connected to the gate line 101, a source electrode 1032 is connected to the data line 102, and a drain electrode 1033 is connected to the pixel electrode 104. Because the gate line 101 has a certain resistance R itself, and a parasitic capacitance Cgd is generated between the gate electrode 1031 and drain electrode 1033, thus, an RC delay circuit is generated thereat. In one gate line 101, therefore, many such RC delay circuits are connected in series. The RC delay circuit can delay the scanning signal applied to the gate line 101, thus the waveform of the scanning signal can be distorted. That is, a square waveform of the scanning signal may not be the same square waveform when reaching a tail end of the gate line 101.

Referring also to FIG. 5, waveforms of the scanning signal adjacent to the scanning driver 110 and far from the scanning driver 110 are shown. "Vg1" denotes a waveform of the scanning signal of one gate line 101 that is at a front end adjacent to the scanning driver 110, and "Vg2" denotes a waveform of the scanning signal of the gate line 101 that is at a tail end distal from the scanning driver 110. That is, the waveform "Vg2" represents the distorted waveform of the scanning signal which is delayed by the serial RC delay circuits. "Von" denotes a turn-on voltage of the TFT 103, and "Voff" denotes a turn-off voltage of the TFT 103. Because of distortions of the waveform of the scanning signal, the TFT 103 is delayed to be turned on, for example, "t1" seconds as shown in FIG. 3. That is, an activated on-state period of time of the TFTs 103 away from the scanning driver 110 is shorter than it is supposed to be.

Because a gray scale voltage is not be applied to the pixel electrode 104 until the corresponding TFT 103 is turned on, the pixel electrode 104 which is away from the scanning driver 110 is lack of charging of the gray scale voltage. Thus, the display image is deteriorated in the corresponding pixel area. Actually, many pixel areas are affected because the corresponding TFTs 103 lack of charging of gray scale voltages. In this case, the image of the LCD 100 has flickers.

What is more, the TFTs 103 adjacent to the tail end can also be delayed to turned off by the distorted waveform of the scanning signal, for example, "t2" seconds as shown in FIG. 3. That is, when a next gate line 101 is scanned, some TFTs 130 connected to the former gate line 101 are still turned on. At this circumstance, gray scale voltages supposed to supply to the next pixel electrodes 104 are also applied to the adjacent former pixel electrodes 104 adjacent to the tail end. In this case, the image of the LCD 100 appears flickers.

What is needed, therefore, is a liquid crystal display and driving method for the liquid crystal display which can overcome the above-described deficiencies.

SUMMARY

An exemplary liquid crystal display includes a liquid crystal panel, a scanning driver, a data driver, and a compensator. The liquid crystal panel includes a plurality of gate lines parallel to each other, a plurality of data lines parallel to each other and intersecting the gate lines, and a plurality of TFTs arranged at each intersection of the gate line and the data line. Each gate line includes a front end and a tail end. The scanning driver is configured for providing a plurality of scanning signals to the gate lines in sequence, and the scanning driver are connected to the front ends of the gate lines. The data driver is configured for providing a plurality of gray scale voltages to the data lines. The compensator is configured for compensating the scanning signals. Wherein the compensator comprises a plurality of switching elements connected to the tail ends of the gate lines respectively. When one gate line is scanned, a high compensating voltage is applied to the tail end through a corresponding switching element to accelerate to turn on the TFTs adjacent to the tail end. And at an end of the scanning time of the gate line, a low compensating voltage is applied to the tail end through the corresponding switching element to accelerate to turn off the TFTs adjacent to the tail end.

Novel features and advantages of the liquid crystal display will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
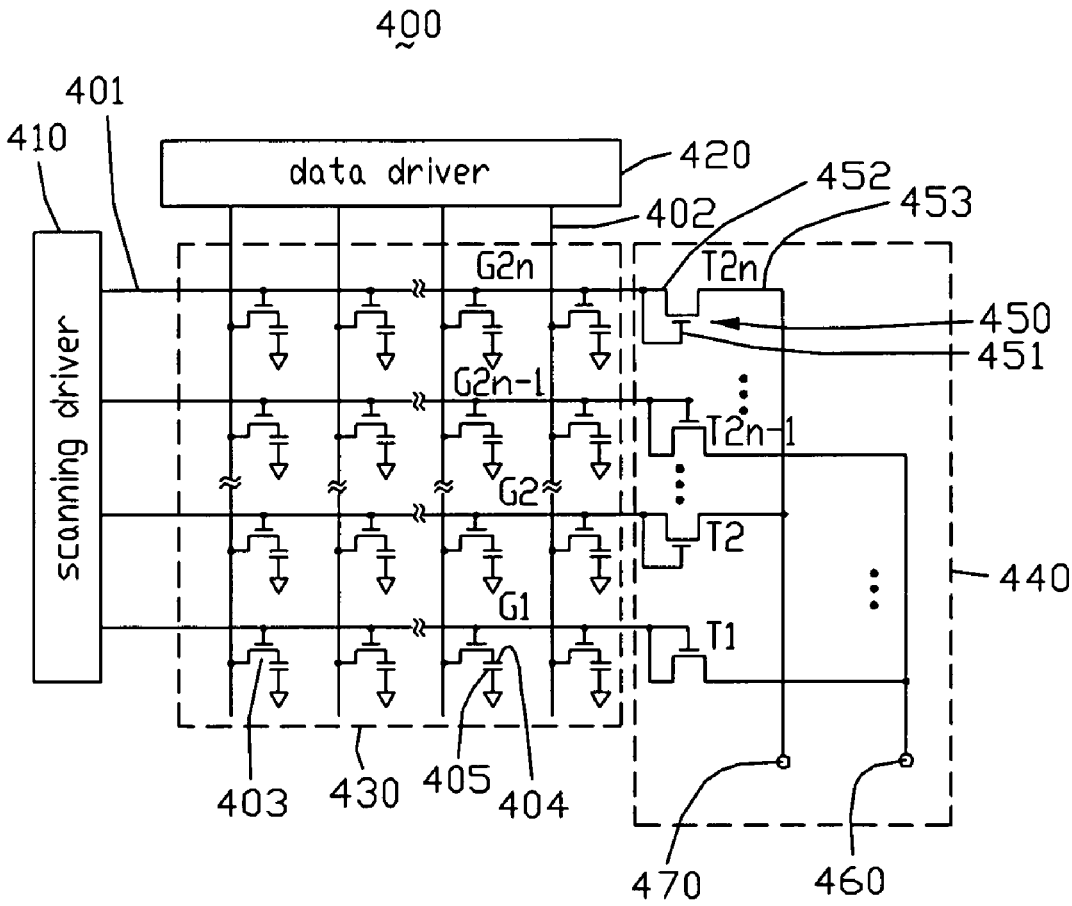
FIG. 1 is a circuit diagram of a liquid crystal display according to an exemplary embodiment of the present invention.

Referring to FIG. 1, a circuit diagram of a liquid crystal display 400 according to an exemplary embodiment of the present invention is shown. The liquid crystal display 400 includes a scanning driver 410, a data driver 420, a liquid crystal panel 430, and a compensator 440. The scanning driver 410 is configured for providing a plurality of scanning signals to the liquid crystal panel 430, and the data driver 420 is configured for providing a plurality of gray scale voltages to the liquid crystal panel 430. The compensator 440 is configured for providing a plurality of compensation signals to the liquid crystal panel 430.

The liquid crystal panel 430 includes a plurality gate lines 401 (G1~G2*n*, n is a natural number) which are parallel to each other, a plurality of data lines 402 which are parallel to each other and intersecting the gate lines 401, a plurality of TFTs 403 arranged at each intersection of the gate line 401 and the data line 402, a plurality of pixel electrodes 404 and a plurality of common electrodes 405 opposite to the pixel electrodes 404. A minimal area constituted by two adjacent gate lines 401 and two adjacent data lines 402 is defined as a pixel area. Each gate line 401 includes a front end adjacent to the scanning driver, and a tail end distal from the scanning driver. The front end of the gate line 401 is connected to the scanning driver 410, and the tail end is connected to the compensator 440. The data lines 402 are connected to the data driver 420.

Each of TFTs 403 includes a gate electrode connected to the gate line 401, a source electrode connected to the data line 402, and a drain electrode connected to the pixel electrode 404. The scanning driver 410 outputs a plurality of scanning signals to the gate lines 401 in sequence. The data driver 120 applies a plurality of gray scale voltages to pixel electrodes 404 through corresponding TFTs 403 when a gate line 401 is scanned.

The compensator 440 includes a plurality of switching elements 450, a first input 460, and a second input 470. The switching elements 450 here are TFTs (T1~T2*n*, n is a natural number), especially are metal-oxide semiconductor field effect transistors. And the TFTs Ti has a lower turn-on threshold voltage than those TFTs 403. The first input 460 and the second input 470 are configured for providing compensating voltages to the gate lines 401 via the switching elements 450. The compensating voltages are square waveforms, and an amplitude of the square waveform is equal to an amplitude of the square waveform of the scanning signals. Each switching element 450 includes a gate electrode 451, a source electrode 452, and a drain electrode 453. The plurality of switching elements 450 are connected to the plurality of the gate lines 401 respectively. In detail, the source electrode 452 and the gate electrode 451 of the TFT Ti (i is a natural number, and $1 \leqq i \leqq n$) are both connected to the tail end of the gate line Gi (i is a natural number, and $1 \leqq i \leqq n$). All drain electrodes 453 of the TFT T2*i*−1 ($1 \leqq i \leqq n$) are connected to the first input 460, and all drain electrodes 453 of the TFT T2*i* ($1 \leqq i \leqq n$) are connected to the input 470. That is, the odd-numbered TFTs 453 are connected to the first input 460, and the even-numbered TFTs 453 are connected to the input 470.

Figure 2:
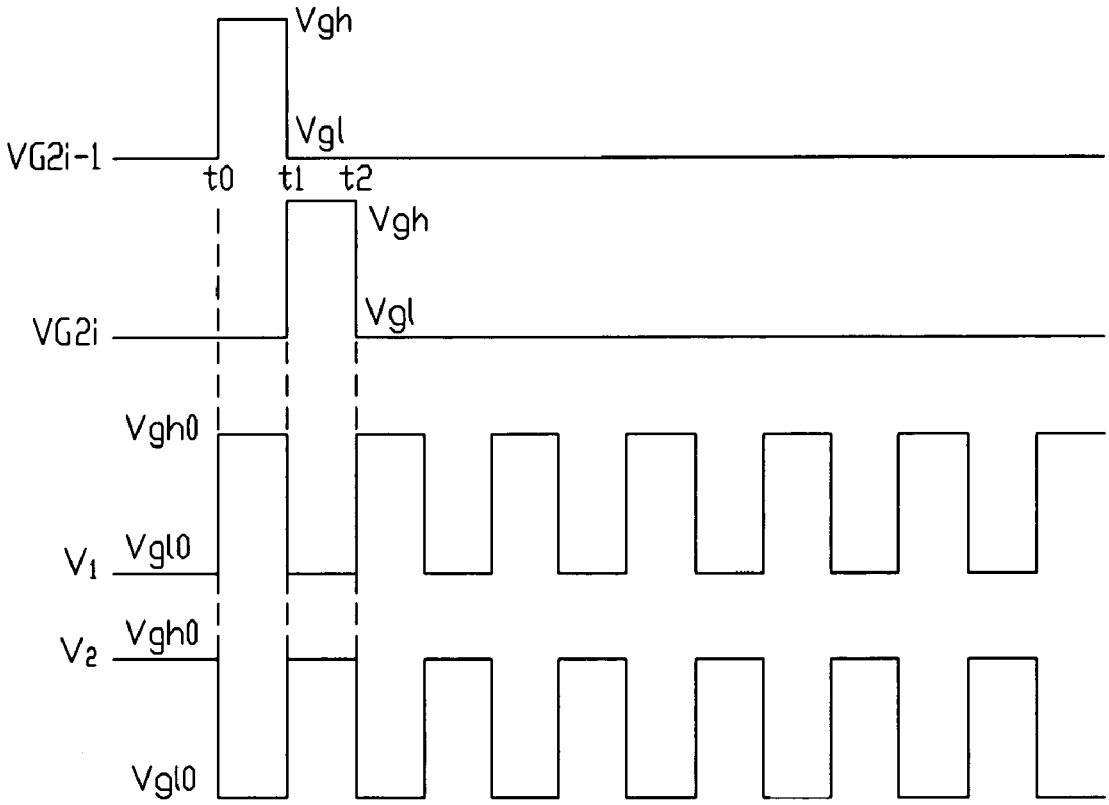
FIG. 2 shows waveforms of driving signals and compensating signals of the liquid crystal display of FIG. 1.
Figure 3:
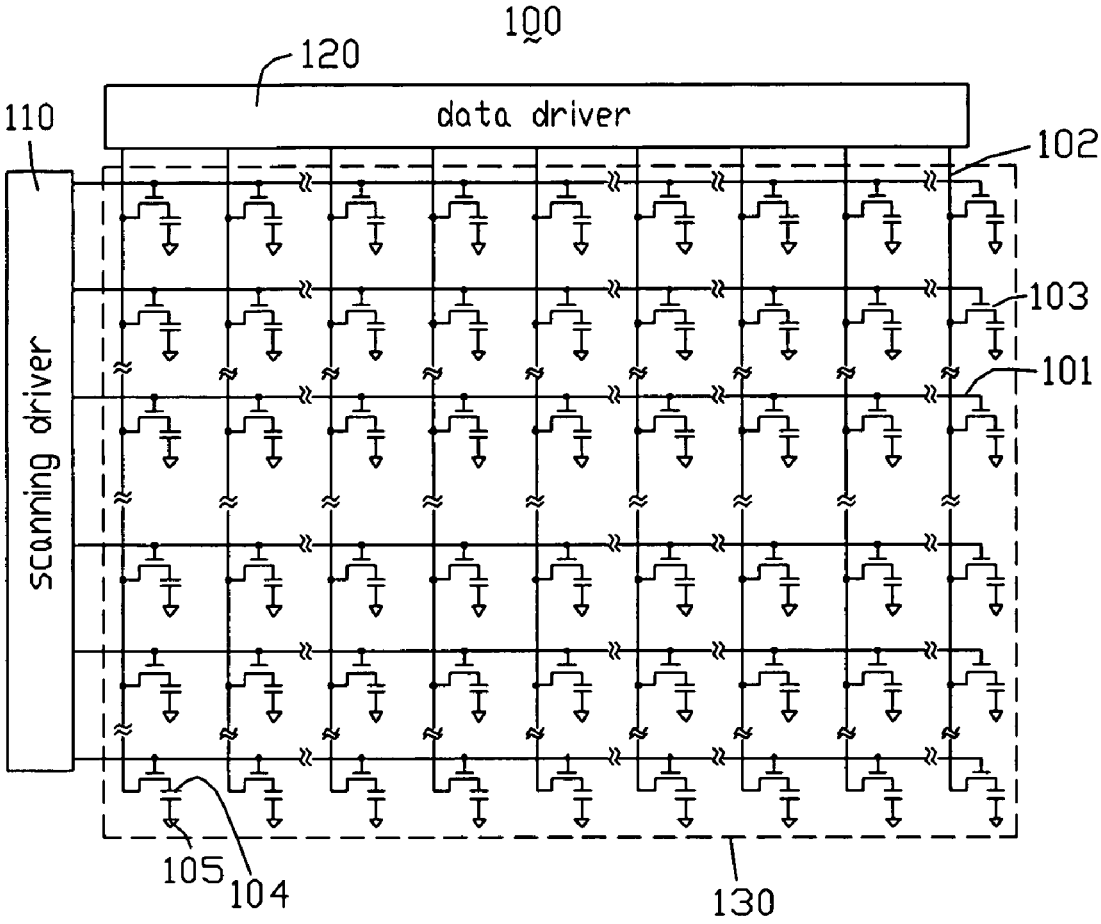
FIG. 3 (RELATED ART)
FIG. 3 is a circuit diagram of a conventional liquid crystal display, the liquid crystal display including a liquid crystal panel, the liquid crystal panel including a plurality of pixel area.
Figure 4:
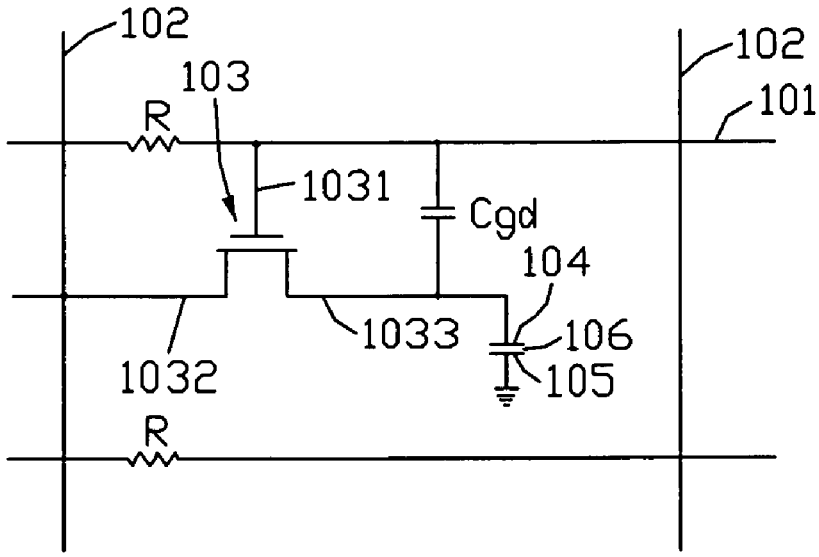
FIG. 4 (RELATED ART)
FIG. 4 is an abbreviated, equivalent circuit diagram of one of the pixel areas of FIG. 3.
Figure 5:
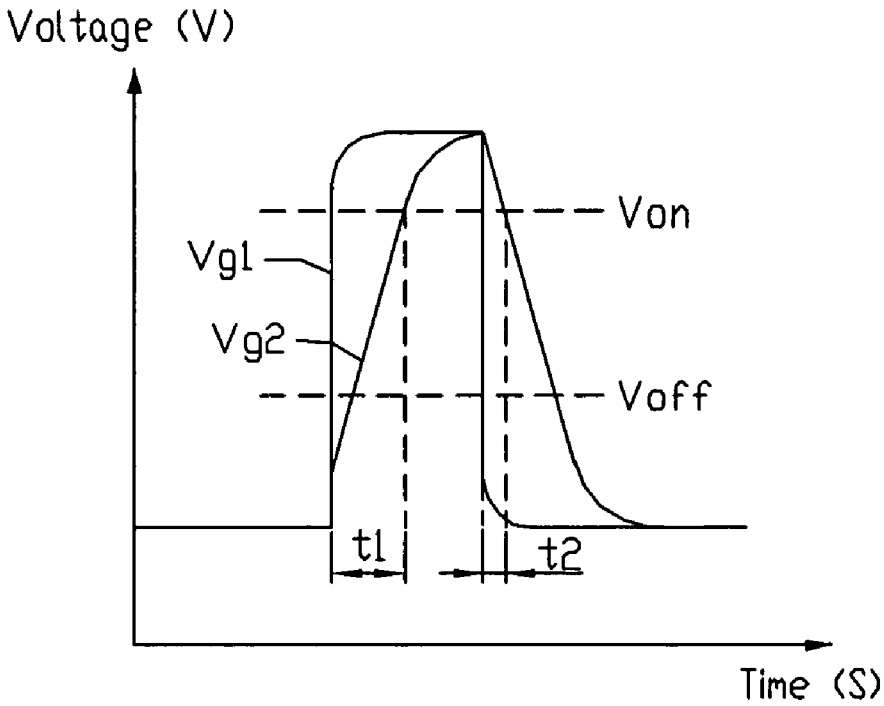
FIG. 5 (RELATED ART)
FIG. 5 is a voltage-time graph relating to the liquid crystal display of FIG. 3, illustrating a gate delay phenomenon.

Referring also to FIG. 2, a plurality of waveforms of scanning signals and compensating signals are shown. "VG2*i*−1" and "VG2*i*" represent the scanning signals applied to the gate line G2*i*−1 and G2*i* respectively. "V1" and "V2" represent the compensating voltages applied to the gate line G2*i*−1 and G2*i* respectively. "Vgh" represents a high voltage to turn on the TFTs 403, and "Vg1" represents a low voltage to turn off the TFTs 403. "Vgh0" represents a high voltage supplied by the first and second inputs 460 and 470, which is equal to that of the "Vgh". "Vg10" represents a low voltage supplied by the first and second inputs 460 and 470, which is equal to that of the "Vg1". As is shown, the "V1" is a reversed voltage of the "V2", that is, when the "V1" is a high voltage "Vgh0", the "V2" is a low voltage "Vg10", and vice versa.

Working principle of the LCD 400 is now described as follows. In the description, G2*i*−1 represents anyone of odd-numbered gate lines 401, and the G2*i* represents anyone of even-numbered gate lines 401 adjacent to the gate line G2*i*−1. T2*i*−1 represents a corresponding TFT connected to G2*i*−1, and T2*i* represents a corresponding TFT connected to G2*i*.

During a period t0~t1, the gate line G2*i*−1 is scanned, that is, the gate line G2*i*−1 is applied a scanning signal Vgh to turn on the TFTs 403 connected thereto, especially the TFTs 403 adjacent to the front end, and the TFT T2*i*−1 is also turned on. At the same time as the gate line G2*i*−1 being scanned, that is a beginning of the scanning of the gate line G2*i*−1, the first input 460 provides a high compensating voltage Vgh0 to the tail end of the gate line G2*i*−1 through the turned-on TFT T2*i*−1. The compensating voltage Vgh0 turns on the TFTs 403 adjacent to the tail end. Thus, the whole TFTs 403 connected to the gate line G2*i*−1 are turned on almost at the same time, the data driver 420 provides gray scale voltages to the pixel electrodes 404 through the corresponding TFTs 403.

During a period t1~t2, the gate line G2*i* is scanned, that is, the gate line G2*i* is applied a scanning signal Vgh to turn on the TFTs 403 connected thereto. Simultaneously, that is an end time of the scanning of the gate line G2*i*−1, the first input 460 provides a low compensating voltage Vg10 to the tail end of the gate line G2*i*−1 through the TFT T2*i*−1. The low compensating voltage accelerates the TFTs 403 adjacent to the tail end to turn off. Thereafter, the TFT T2*i*−1 is also turned off.

Similarly to an operation of the gate line G2*i*−1 being scanned, when the gate line G2*i* is scanned, the second input 470 supplies a high compensating voltage Vgh0 to the tail end of the gate line G2*i* through the TFT T2*i* for accelerating to turn on the TFTs 403 adjacent to the tail end. At an end of the period t1~t2, the second input 470 supplies a low compensating voltage Vg10 to the tail end of the gate line G2*i* through the TFT T2*i* for accelerating to turn off the TFTs 403 adjacent to the tail end.

Unlike in a conventional LCD, the LCD 400 includes the compensator 440 which includes the plurality of switching elements 450, and the first and second inputs 460, 470. When the gate line G2*i*−1 is scanned, the first input 460 supplies a high compensating voltage through the switching element 450 to accelerate to turn on the TFTs 403 adjacent to the tail end of the gate line G2*i*−1. When a next adjacent gate line G2*i* is scanned, the first input switches to supply a low compensating voltage to accelerate to turn off the TFTs 403 adjacent to the tail end of the gate line G2*i*−1. Simultaneously, the second input 470 supplies a high compensating voltage through the switching element 450 to accelerate to turn on the TFTs 403 adjacent to the tail end of the gate line G2*i*. Therefore, charging and discharging time of the pixel electrodes 404 adjacent to the tail end is not be shortened or delayed. The LCD 400 therefore can overcome the flicker phenomenon and has satisfactory quality.

It is to be understood, however, that even though numerous characteristics and advantages of preferred embodiments have been set out in the foregoing description, together with details of the structures and functions of the embodiments, the disclosure is illustrative only; and that changes may be made in detail, especially in matters of shape, size, and arrangement of parts within the principles of the present invention to the full extent indicated by the broad general meaning of the terms in which the appended claims are expressed.

What is claimed is:

1. A liquid crystal display comprising:

a liquid crystal panel comprising a plurality of gate lines parallel to each other, a plurality of data lines parallel to each other and intersecting the gate lines, each gate line comprising a front end and a tail end;

a plurality of first thin film transistors arranged at each intersection of the gate line and the data line;

a scanning driver configured for providing a plurality of scanning signals to the gate lines in sequence, the scanning driver being connected to the front ends of the gate lines;

a data driver configured for providing a plurality of gray scale voltages to the data lines; and a compensator configured for compensating the scanning signals, wherein the compensator comprises a plurality of switching elements connected to the tail ends of the lines respectively, when one gate line is scanned, a high compensating voltage being applied to the tail end of the one gate line through a corresponding switching element to accelerate to turn on the first thin film transistors adjacent to the tail end, and at an end of the scanning time of the one gate line, a low compensating voltage being applied to the tail end of the one gate line through the corresponding switching element to accelerate to turn off the first thin film transistors adjacent to the tail end, wherein the high compensating voltage and the low compensating voltage are provided to the tail end of the one gate line through the same switching element which is connected to the tail end of the one gate line;

wherein each switching element comprises a second thin film transistor, and the switching elements have a lower turn on threshold voltage than the first thin film transistors arranged at each intersection of the gate line and the data line;

wherein the compensator further comprises a first input configured to output the high compensating voltage and the low compensating voltage to the tail ends of the odd-numbered gate lines and a second input configured to output the high compensating voltage and the low compensating voltage to the tail ends of the even-numbered gate lines, the second thin film transistor further comprises a gate electrode, a source electrode directly connected to the gate electrode and a drain electrode, the source electrode and the gate electrode of the second thin film transistor being connected to the tail end of the corresponding gate line, the first input being connected to the drain electrodes of the second thin film transistors connected to the odd-numbered gate lines respectively, and the second input being connected to the drain electrodes of the second thin film transistors connected to the even-numbered gate lines respectively.

2. The liquid crystal display in claim 1, wherein the high compensating voltage and the low compensating voltage output by the first input form a first square waveform, the high compensating voltage and the low compensating voltage output by the second input form a second square waveform, and the first square waveform and the second square waveform have inverse phases.

3. The liquid crystal display in claim 2, wherein an amplitude of the high compensating voltage is equal to an amplitude of a scanning signal provided to the one gate lines.

4. The liquid crystal display in claim 1, wherein the second thin film transistors are metal-oxide semiconductor field effect transistors.

5. A driving method for a liquid crystal display, the liquid crystal display comprising a scanning driver, a liquid crystal panel, and a compensator, the liquid crystal panel comprising a plurality of gate lines G1~G2*n*, the compensator comprising a plurality of switching elements corresponding to the plurality of the gate lines one to one, each switching element being connected to an end of the gate line G1 distal from the scanning driver, where n is a natural number, $1 \leqq i \leqq 2n$, and i is a natural number, the method comprising the following:

when the scanning driver applies a high scanning voltage to the gate line Gi, the compensator applies a high compensating voltage to the end of the gate line Gi distal from the scanning driver, and when the scanning driver applies a high scanning voltage to the gate line Gi+1, the scanning driver applies a low voltage to the gate line Gi, and the compensator applies a low compensating voltage to the end of the gate line Gi distal from the scanning driver, wherein the high compensating voltage and the low compensating voltage are applied to the end of the gate line Gi distal from the scanning driver through the same switching element which is connected to the tail end of the gate line Gi;

wherein the switching element comprises a second thin film transistor, the second thin film transistor comprising a gate electrode, a source electrode and a drain electrode, the gate electrode of the second thin film transistor being directly connected to the source electrode, the source electrode of the second thin film transistor being connected to the tail end of the gate line Gi, and the drain electrode of the second thin film transistor configured to receive the high compensating voltage and the low compensating voltage.

6. The driving method for a liquid crystal display in claim 5, wherein an amplitude of the high scanning voltage is equal to an amplitude of the high compensating voltage, and an amplitude of the low scanning voltage is equal to an amplitude of the low compensating voltage.

7. The driving method for a liquid crystal display in claim 5, wherein the compensator further comprises a first input and a second input, the first input configured to apply the high compensating voltage and the low compensating voltage to the drain electrode of the second thin film transistor connected to odd-numbered gate line, and the second input configured to apply the high compensating voltage and the low compensating voltage to the drain electrode of the second thin film transistor connected to even-numbered gate line.

8. The driving method for a liquid crystal display in claim 7, wherein the high compensating voltage and the low compensating voltage applied by the first input form a first square waveform, the high compensating voltage and the low compensating voltage applied by the second input form a second square waveform, and the first square waveform and the second square waveform have inverse phases.

9. A liquid crystal display comprising:

a liquid crystal panel comprising a plurality of gate lines G1~G2*n* parallel to each other, a plurality of data lines parallel to each other and intersecting the gate lines G1~G2*n*, each of the gate lines G1~G2*n* comprising a front end and a tail end, where n is a natural number;

a plurality of first thin film transistors arranged at each intersection of the gate line and the data line, a gate electrode of each first TFT being connected to the corresponding gate line Gi, where $1 \leqq i \leqq 2n$, and i is a natural number;

a scanning driver configured for scanning the gate lines G1~G2*n* in sequence, the scanning driver being connected to the front ends of the gate lines G1~G2*n;* a data driver configured for providing a plurality of gray scale voltages to the data lines; and a compensator configured for compensating the scanning signals, wherein when the scanning driver applies a high scanning voltage to the gate line Gi to turn on the first thin film transistors connected the gate line Gi, the compensator applies a high compensating voltage to the tail end of the gate line Gi to accelerate to turn on the first thin film transistors adjacent to the tail end of the gate line Gi; and when the scanning driver applies a high scanning voltage to the gate line Gi+1 to turn on the first thin film transistors connected the gate line Gi+1, the scanning driver applies a low voltage to the gate line Gi to turn off the first thin film transistors connected the gate line Gi, and the compensator applies a low compensating voltage to the tail end of the gate line Gi to accelerate to turn off the first thin film transistors adjacent to the tail end of the gate line Gi, wherein the compensator comprises a plurality of switching elements corresponding to the plurality of the gate lines one to one, each switching element is connected to the tail end of the corresponding gate line Gi, and the high compensating voltage and the low compensating voltage are applied to the tail end of the gate line Gi through the same switching element which is connected to the tail end of the gate line Gi;

wherein the switching element comprises a second thin film transistor, the second thin film transistor comprising a gate electrode, a source electrode and a drain electrode, the gate electrode of the second thin film transistor being directly connected to the source electrode, the source electrode of the second thin film transistor being connected to the tail end of the gate line Gi, and the drain electrode of the second thin film transistor configured to receive the high compensating voltage and the low compensating voltage.

10. The liquid crystal display in claim 9, wherein the second thin film transistor has a lower turn on threshold voltage than the first thin film transistors arranged at each intersection of the gate line and the data line.

11. The liquid crystal display in claim 9, wherein the second thin film transistor is a metal-oxide semiconductor field effect transistor.

12. The liquid crystal display in claim 9, wherein the compensator further comprises a first input and a second input, the first input configured to apply the high compensating voltage and the low compensating voltage to the drain electrodes of the second thin film transistors connected to odd-numbered gate lines, and the second input configured to apply the high compensating voltage and the low compensating voltage to the drain electrodes of the second thin film transistors connected to even-numbered gate lines.

13. The liquid crystal display in claim 12, wherein the high compensating voltage and the low compensating voltage applied by the first input form a first square waveform, the high compensating voltage and the low compensating voltage applied by the second input form a second square waveform, and the first square waveform and the second square waveform have inverse phases.

14. The liquid crystal display in claim 9, wherein an amplitude of the high scanning voltage is equal to an amplitude of the high compensating voltage, and an amplitude of the low scanning voltage is equal to an amplitude of the low compensating voltage.

* * * * *